US006299690B1

(12) United States Patent
Mongeon et al.

(10) Patent No.: US 6,299,690 B1
(45) Date of Patent: Oct. 9, 2001

(54) DIE WALL LUBRICATION METHOD AND APPARATUS

(75) Inventors: Paul-Emile Mongeon, Laval; Sylvain Pelletier, Ste. Julie; Abdelouahab Ziani, St. Thomas, all of (CA)

(73) Assignee: National Research Council of Canada, Ottawa (CA)

( * ) Notice: Subject to any disclaimer, the term of this patent is extended or adjusted under 35 U.S.C. 154(b) by 0 days.

(21) Appl. No.: 09/442,411

(22) Filed: Nov. 18, 1999

(51) Int. Cl.[7] ..... B05B 5/12; B05B 5/025

(52) U.S. Cl. ..... 118/622; 118/620; 118/621; 425/100; 72/45

(58) Field of Search ..... 118/620, 621, 118/622; 72/39, 41, 42, 43, 44, 45; 425/96, 97, 98, 99, 100

(56) References Cited

U.S. PATENT DOCUMENTS

| | | | | |
|---|---|---|---|---|
| 3,132,379 | | 5/1964 | Crane . | |
| 3,857,363 | | 12/1974 | Ferlito . | |
| 3,988,524 | | 10/1976 | Dreyer et al. . | |
| 4,062,678 | | 12/1977 | Dreyer et al. . | |
| 4,834,800 | | 5/1989 | Semel . | |
| 4,840,052 | | 6/1989 | Takata . | |
| 5,017,122 | * | 5/1991 | Staniforth | 425/100 |
| 5,069,714 | | 12/1991 | Gosselin . | |
| 5,432,223 | | 7/1995 | Champagne et al. . | |
| 5,642,637 | | 7/1997 | Crum . | |
| 5,682,591 | | 10/1997 | Inculet et al. . | |
| 5,725,670 | * | 3/1998 | Wilson et al. | 118/629 |

FOREIGN PATENT DOCUMENTS 2 187 088 1/1974 (FR) .

WO 98 04357 2/1998 (WO) .

* cited by examiner

*Primary Examiner*—Richard Crispino
*Assistant Examiner*—Yewebdar T. T.
(74) *Attorney, Agent, or Firm*—H. Wayne Rock

(57) ABSTRACT

A method of lubricating the wall surfaces of a die cavity used in powder metallurgy involves spraying the wall surfaces with tribocharged particles of a lubricant material. The method is carried out by means of an apparatus centered about a plug member which has a three-dimensional shape conforming generally to that of the article to be formed. The plug member is slightly smaller than the article so that when the plug member is inserted into the die cavity there is a small, but uniform, gap created between the outer wall surfaces of the plug member and the walls of the die cavity. The plug member is secured to a closing plate which can be inserted into the die cavity so as to be sealed therewith. The closing plate is provided with vent holes and the plug member has a plurality of spaced apart tubes extending therethrough, which tubes exit at one or more of the wall surfaces of the plug member. The lubricant material is fed using an inert gas under pressure through tubing which tribocharged the lubricant particles and the tribocharged particles are sprayed from the tubes in the plug member into the gap so that they are electrostatically attracted to the walls of the die cavity and adhere thereto. Any excess gas and lubricant exits the gap through the vent holes in the closing plate. A uniform thin coating of lubricant is created on the walls of the die cavity. The green density of the article formed in the die is greater, and the ejection force required to remove the formed article from the die cavity is less, than with existing methods and apparatus.

8 Claims, 14 Drawing Sheets

FIGURE 4.0: SEQUENCE OF PRESS OPERATIONS USED WITH THE DRY LUBRICANT APPLICATOR APPARATUS
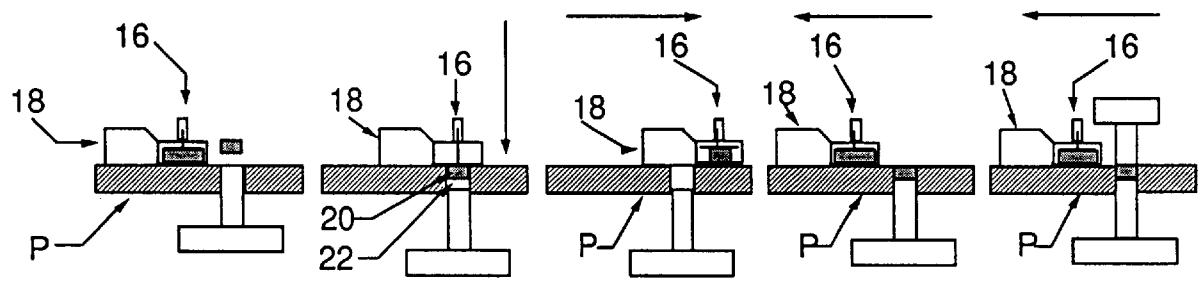
| | | | | | |
|---|---|---|---|---|---|
| MEASUREMENT OF LUBRICANT | YES | NO | YES | YES | YES |
| SYNCHRONIZATION | NO | YES | NO | NO | NO |
| DOWNSTROKE OF CONFINEMENT BLOCK | NO | YES | NO | NO | NO |
| TRANSPORTATION/TRIBOCHARGING OF POWDERS AND COATING OF WALL'S CAVITY | NO | YES | NO | NO | NO |
| UPSTROKE OF CONFINEMENT BLOCK | YES | NO | YES | YES | YES |

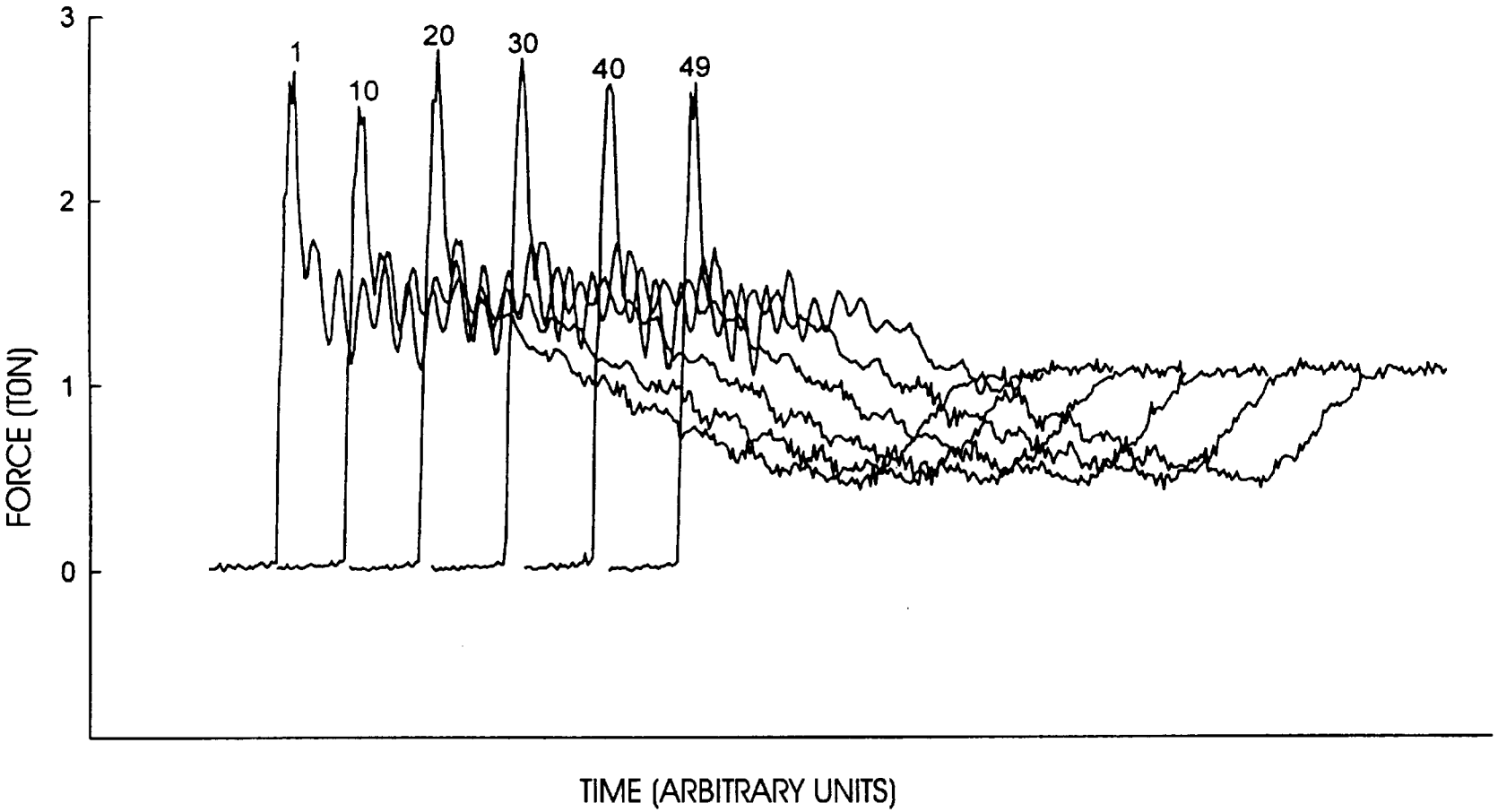
FIG. 5: EJECTION CURVES FOR A FORMULATION COMPOSED OF ATOMET 1001, 0.6 WT% GRAPHITE AND 0.3 WT% ACRAWAX C PRESSED WITH DIE WALL LUBRICATION AT 65°C/620MPa

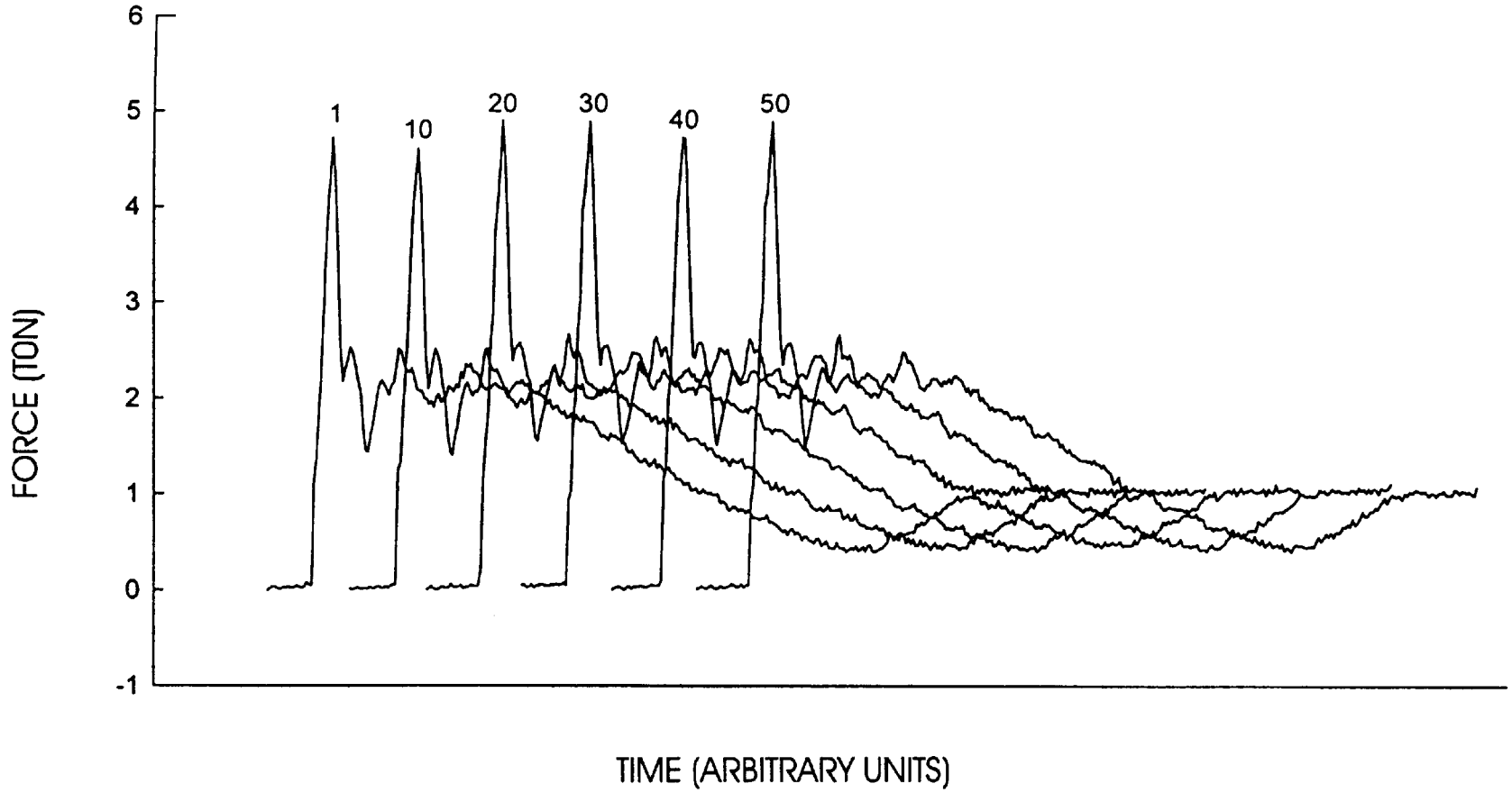
FIG. 6: EJECTION CURVES FOR A FORMULATION COMPOSED OF ATOMET 1001, 0.6 WT% GRAPHITE AND 0.6 WT%ACRAWAX C PRESSED WITHOUT DIE WALL LUBRICATION AT 65°C/620 MPa Top view Side view

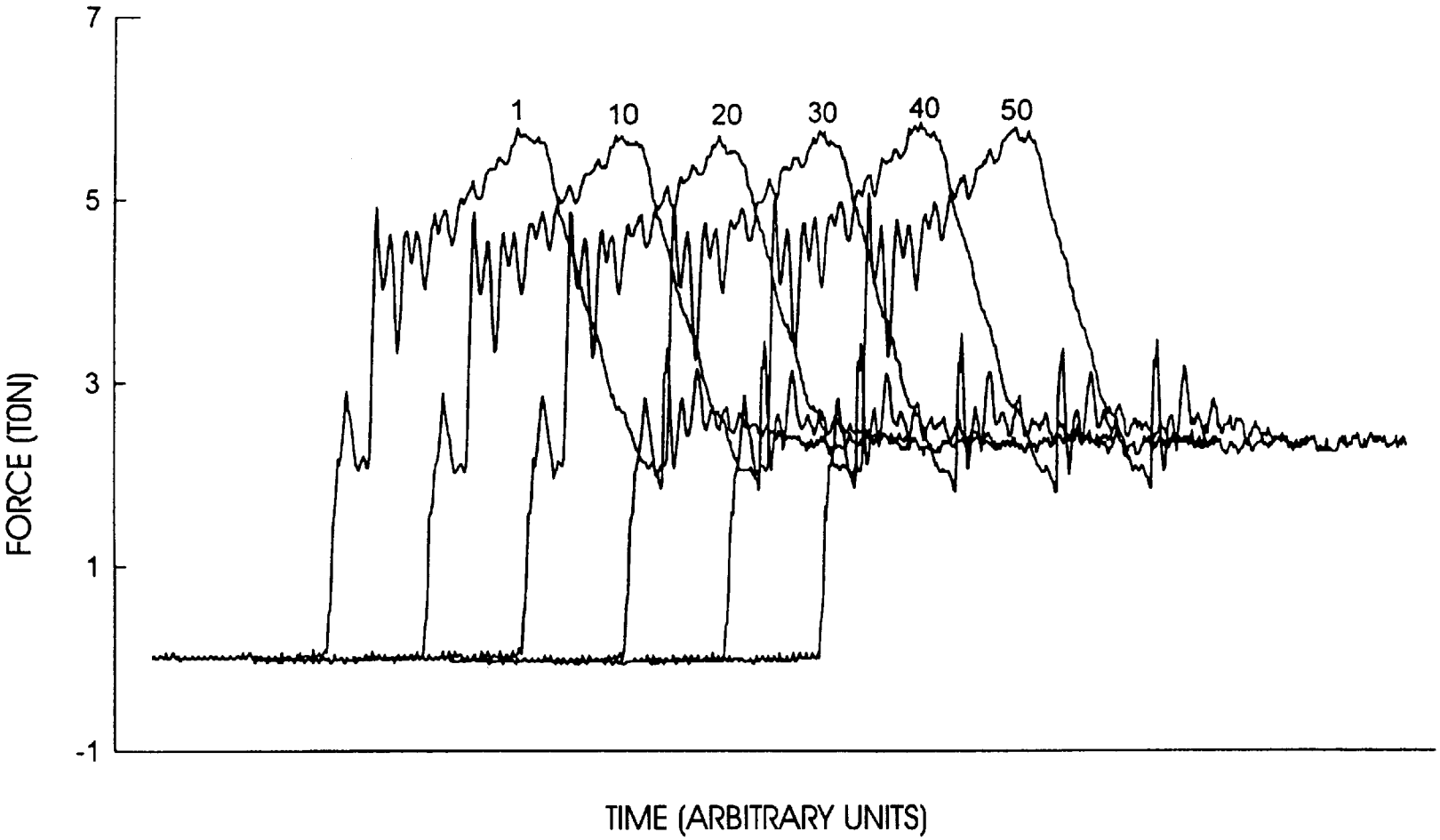
FIG. 8: EJECTION CURVES FOR A FORMULATION COMPOSED OF ATOMET 1001, 0.6 WT% GRAPHITE AND 0.6 WT% ACRAWAX C PRESSED WITH DIE WALL LUBRICATION AT 65°C/620 MPa

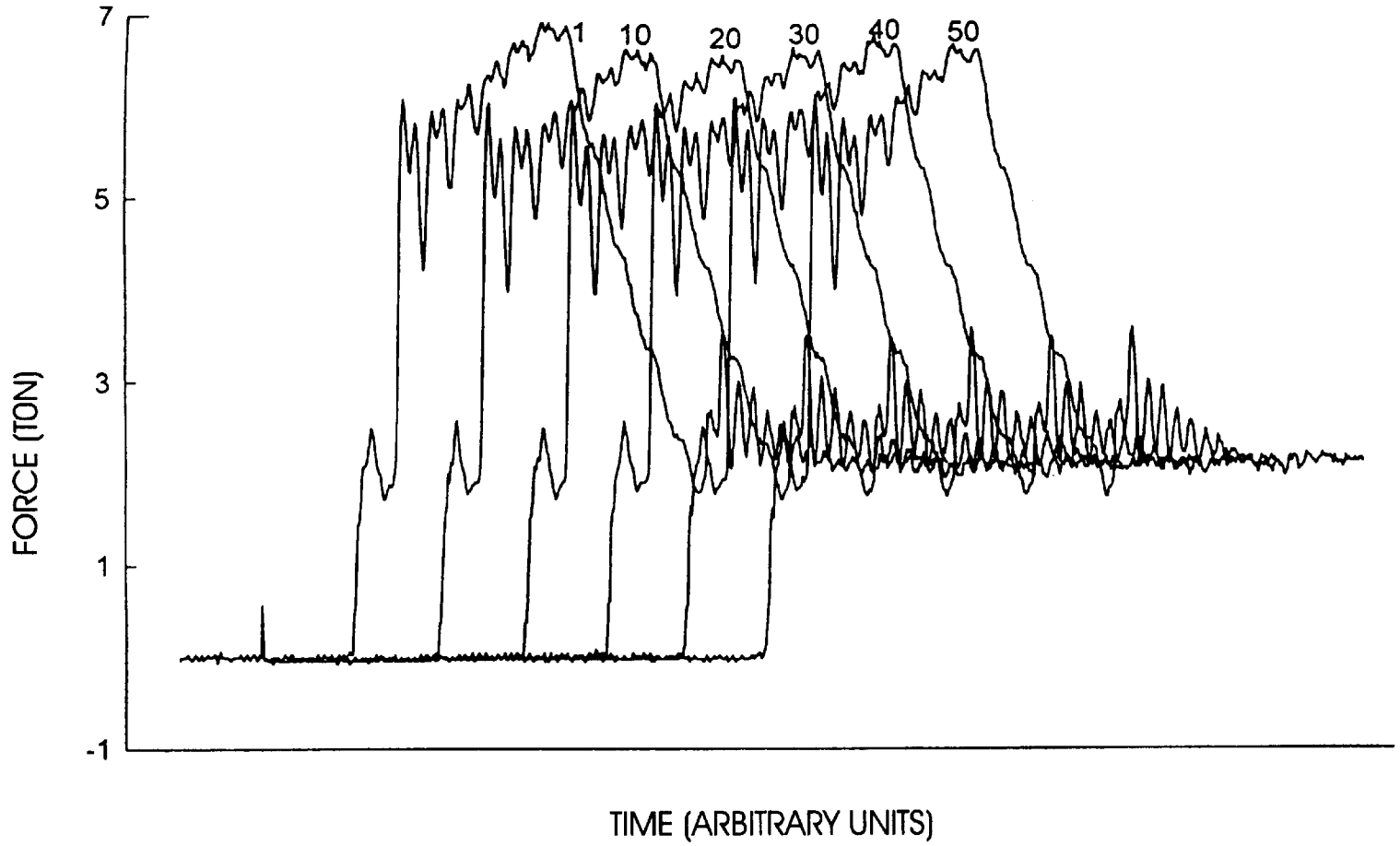
FIG.9: EJECTION CURVES FOR A FORMULATION COMPOSED OF ATOMET 1001, 0.6 WT% GRAPHITE AND 0.6 WT% ACRAWAX C PRESSED WITHOUT DIE WALL LUBRICATION AT 65°C/620 MPa

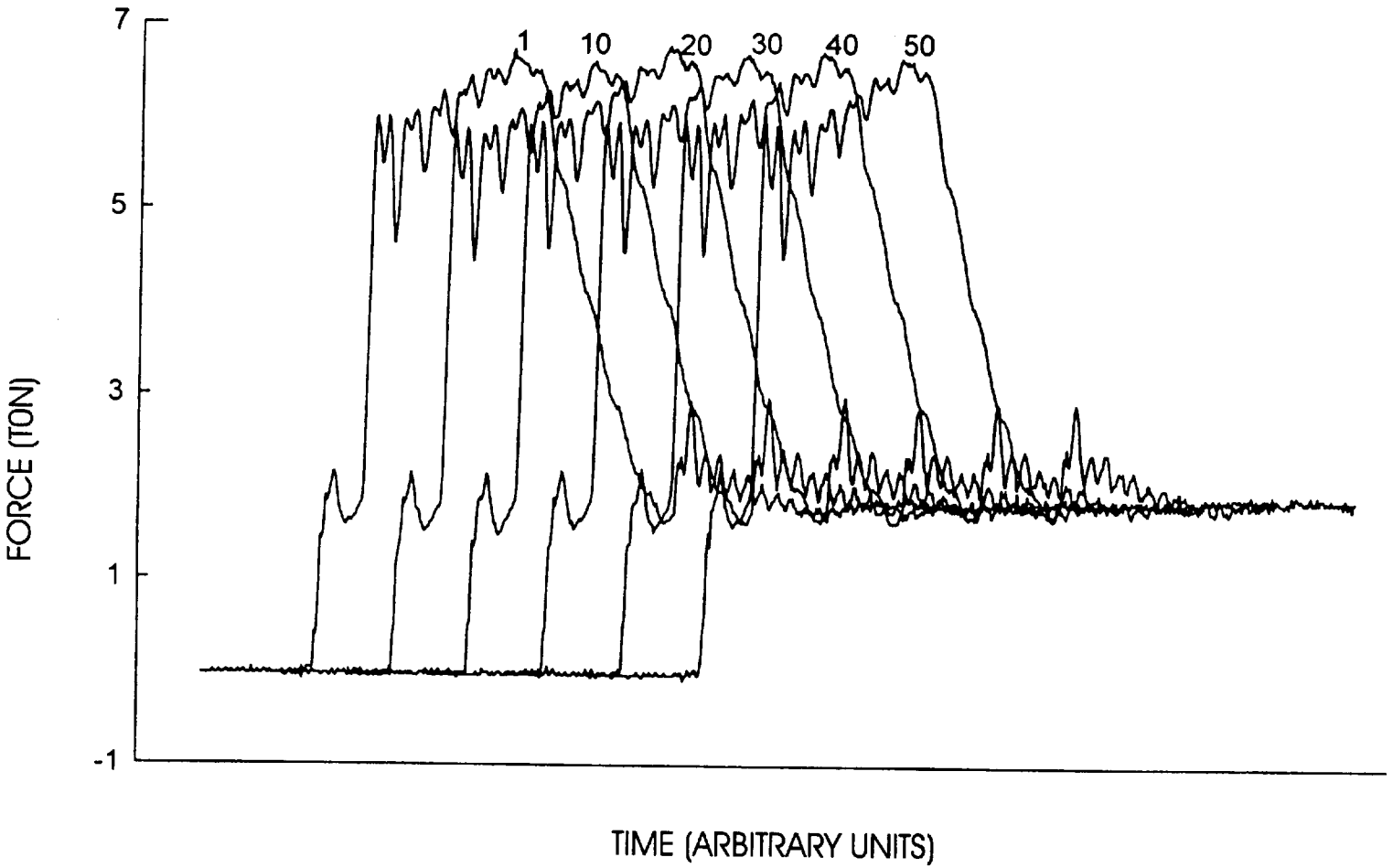
FIG.10: EJECTION CURVES FOR A FORMULATION COMPOSED OF ATOMET 1001, 0.6 WT% GRAPHITE AND 0.3 WT% ACRAWAX C PRESSED WITH DIE WALL LUBRICATION AT 65°C/620 MPa

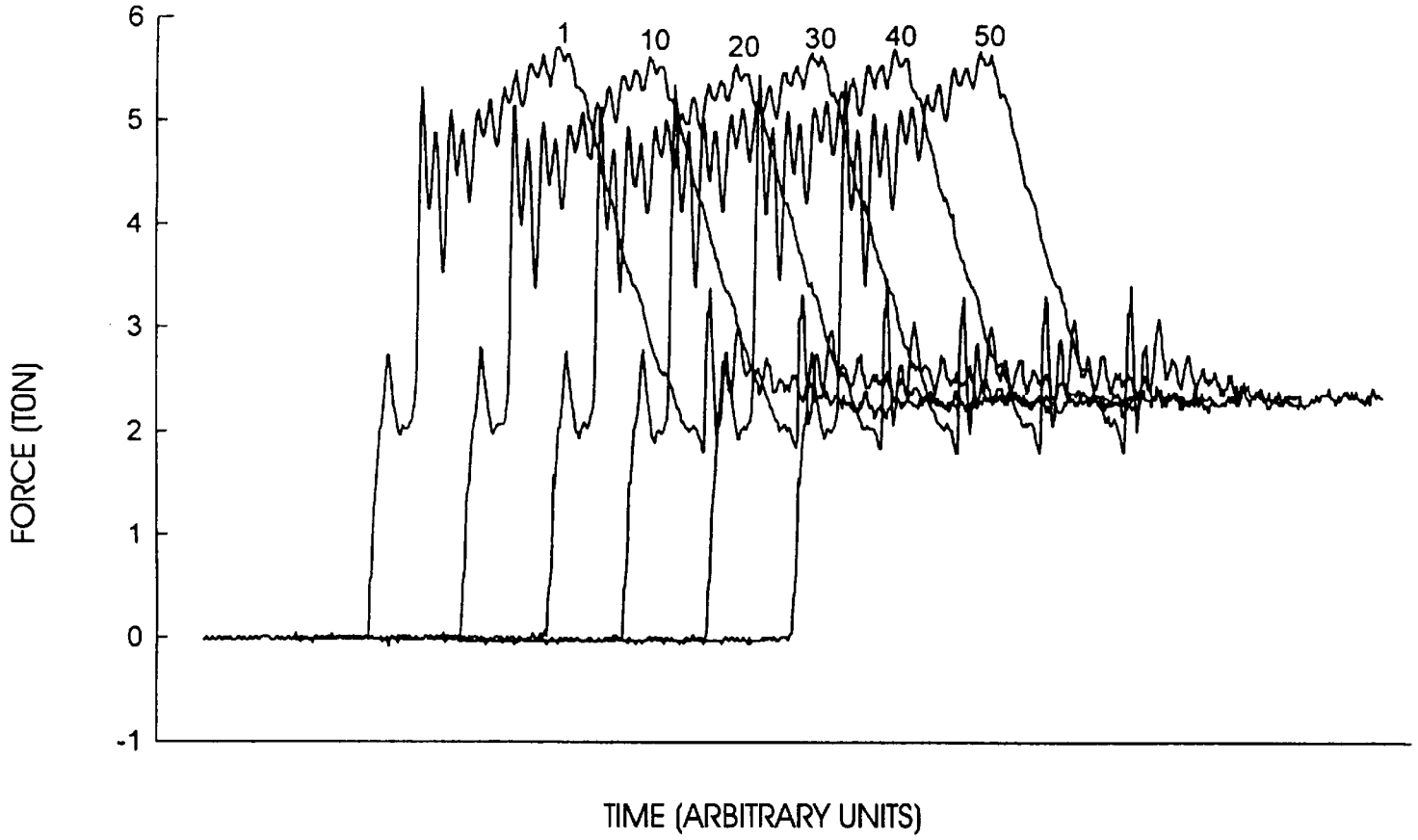
FIG.11: EJECTION CURVES FOR A FORMULATION COMPOSED OF ATOMET 1001, 0.6 WT% GRAPHITE AND 0.3 WT% ACRAWAX C PRESSED WITH DIE WALL LUBRICATION AT 65°C/483 MPa

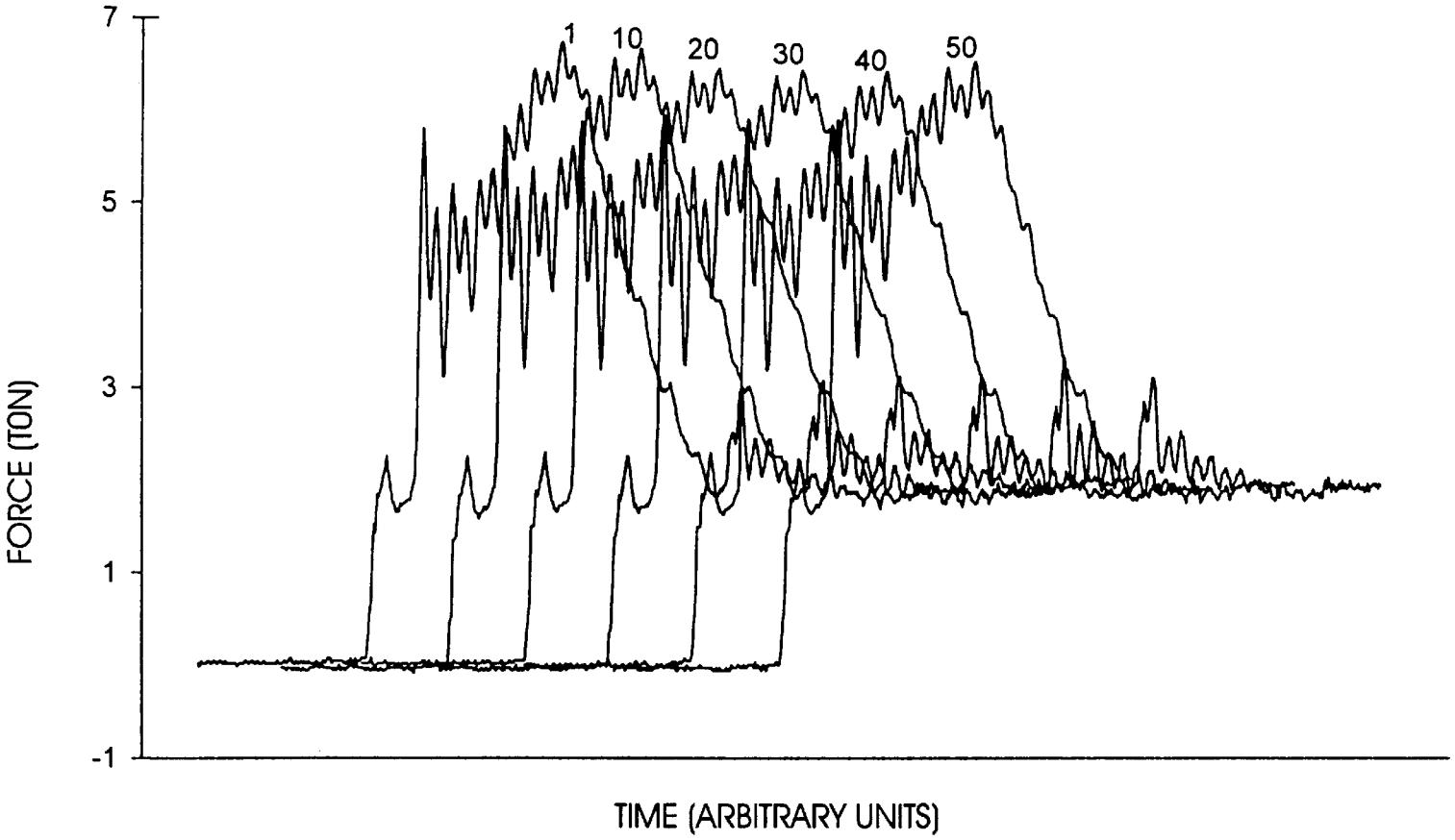
FIG.12: EJECTION CURVES FOR A FORMULATION COMPOSED OF ATOMET 1001, 0.6 WT% GRAPHITE AND 0.3 WT% ACRAWAX C PRESSED WITHOUT DIE WALL LUBRICATION AT 65°C/483 Mpa

DIE WALL LUBRICATION METHOD AND APPARATUS

BACKGROUND OF THE INVENTION

1. Field of the Invention

This invention relates to metallic powders and, in particular, to the compaction of such powders to form metallic parts using powder metallurgy. However, this invention is not limited to the powder metallurgy field and can be applied in the pharmaceutical field for instance or any other fields requiring the lubrication of a die cavity prior to shaping.

2. Brief Description of the Background Art

In powder metallurgy ("P/M"), metal powders are compacted in a die cavity to form a green compact which is then heat treated or sintered at relatively high temperatures to create metallic bonds between particles to form a metallic part. During compaction, friction is generated between the metal powder particles themselves and also between the metal powder particles and the die wall, causing both adhesive wear on the die surfaces and lamination or breakage of the green compact after ejection from the die cavity. In order to decrease the friction between the metal powder particles and the die walls and to decrease the ejection force required to eject the green compact from the die cavity, dry lubricants have been historically added to the metal powder mixture. These are generally referred to as internal lubricants since they are admixed with the metal powder to be compacted.

It is well known that wet lubricants promote clumping of the metal powder and adversely affect the flow characteristics of P/M materials, and then they cannot be used successfully. On the other hand, dry lubricants have been used successfully since they are non-binding and do not affect flow characteristics. Due to the pressures and temperatures involved during compaction, dry lubricants typically melt and flow between the metal powder particles and lubricate the die walls. However, one disadvantage of using a dry lubricant in the metal powder formulation is that both the final density and the strength of the metallic part are less than theoretically achievable when no lubricant is admixed. In fact, the density of common lubricants used is usually lower than the density of the metal powders used.

Prior attempts at eliminating the addition of internal lubricants in the metal powder composition focused on spraying onto the die walls liquid lubricants, or dry lubricants that were dispersed in solvents. However, the poor distribution of liquid applied to the die walls limited the size and the shape of the green compact. Moreover, the use of dispersed dry lubricants poses numerous health, safety and environmental hazards due to the presence of volatile solvents.

Up to now, only a few systems have been developed to apply dry lubricants to die cavity walls. One system described in the prior art uses a tribogun to spray, directly from the outside of the die cavity, an electrostatically charged lubricant into the die cavity. Although this technique is simple, it can only be used for small dies and does not achieve uniform distribution of the lubricant in the die cavity. In another device, such as the one described in U.S. Pat. No. 4,840,052, a fluid mixture consisting of a lubricant and compressed air is used to lubricate the surfaces of die punches of a forging press before the part is made. In this case the lubricant coating applied with this device is localized and non-uniform. Another example of a device used to apply lubricant is the one described in U.S. Pat. No. 5,642, 637 which is dedicated to die forging. In this case, the forging cavity was not coated and the lubrication, as in U.S. Pat. No. 4,840,052, was limited to the punch surfaces. Moreover, in this patent, the surfaces to be lubricated are not located in a die cavity.

The objective of the present invention is to overcome drawbacks and disadvantages of the prior art, and to provide an improved method of applying dry lubricant to die cavity walls in order to improve the manufacture of metallic parts by powder metallurgy. The apparatus of the present invention was developed to apply a constant, thin and uniform dry lubricant to the die cavity walls to make improved quality powder metallurgy parts.

SUMMARY OF THE INVENTION

The present invention describes a method for making a metallic part that eliminates or reduces as much as possible the ratio of internal lubricant to admixed metal powder compositions. The present invention is also intended to provide an environmentally safe method for making metallic parts. A further objective of the present invention is to provide a method for making a metallic part having an improved surface finish and green density. Yet another object of the present invention is to provide an apparatus capable of uniformly spraying a tribostatically charged dry lubricating material onto the die cavity walls to reduce ejection forces and wear on the compaction tool.

These objects and others are provided by a novel apparatus that can be used in the manufacture of a metallic part by powder metallurgy wherein the metal powder composition is compacted in a die cavity whose wall surfaces have been lubricated following a new method of tribocharging sprayed lubricants in dry form prior to compaction. The use of this apparatus and the new method allow a reduction or elimination of the amount of internal lubricant added to the mix, resulting in a metallic part having greater density, and a better surface finish. In addition, the method of this invention is environmentally safe since dry lubricants may be employed without being dispersed in volatile solvents.

The present invention utilizes a unit for measuring a precise quantity of dry lubricant, a flow path including tribocharging means for creating an electrically charged lubricating material, and a unit to move a part-shaped confining block or plug which is adapted for spraying the lubricant into the die cavity. The confining block or plug generally reproduces the shape of the part to be made but has slightly smaller dimensions compared to the part to be made, so that when the plug is positioned within the die cavity there is a narrow gap defined between the outer surface of the plug and the inner surface of the die cavity as defined by the walls thereof. Vent holes located in a closing plate to which the plug is fixed assure a preferential path for lubricant flow and avoid any gas turbulence in the die cavity during the coating process. In addition, but only if necessary, small metallic electrodes, metallic tape fixed on the plug, or metallic plating on the surface of the plug, can be used to repel the charged lubricating material from the plug towards the grounded die cavity as disclosed in U.S. Pat. No. 5,682,591, thereby enhancing the attraction between the lubricant and the die cavity walls.

More specifically, the present invention provides a method of lubricating a wall surface of a die cavity in which a powder will be compacted to form a three-dimensional article and from which a complete compacted article will be ejected, comprising the steps of providing a plug member secured to a closing plate and having a three-dimensional shape generally conforming to that of the article, the plug member having a plurality of tubes extending therethrough to exit at one or more outer wall surfaces of the plug member, the tubes being spaced apart adjacent the periphery of the plug member;

providing a source of lubricant;

inserting the plug member into the die cavity, with the plug member defining a narrow gap between the outer wall surfaces thereof and adjacent walls of the cavity;

feeding lubricant using a pressurized inert gas from the source through tribocharging means to the tubes of the plug member to exit into the gap whereby the lubricant is attracted to the walls of the cavity;

permitting excess gas and lubricant to exit the gap via venting means in the closing plate to assure a preferred path of lubricant flow and to avoid gas turbulence in the die cavity; and withdrawing the plug member from the die cavity, leaving a coating of lubricant on the walls of the die cavity.

In the method defined above, the die cavity and the metal powder composition, or only the metal powder composition, may be preheated to a high temperature up to 250° C. (~500° F.) prior to the compacting step. In addition, electrodes, metallic tape or metallic plating connected to a reversible DC voltage unit as described in U.S. Pat. No. 5,682,591 and fixed to theplug can be used to repel the tribocharged lubricant particles toward the die walls.

The above method may be carried out in apparatus for lubricating a wall surface of a die cavity in which a powder will be compacted to form a three-dimensional article and from which the article will be ejected, the die cavity having walls defining the shape of the article, the apparatus comprising: a plug member having a three-dimensional shape generally conforming to that of the article, the plug member being insertable into the die cavity so as to define a narrow gap between the walls of the cavity and adjacent outer wall surfaces of the plug member; a closing plate to which the plug member is secured; means for moving the plug member into the cavity and outwardly therefrom; means for sealing the plate to the die cavity when the plug member is within the die cavity; a plurality of tubes spaced apart adjacent the periphery of the plug member, extending therethrough and exiting at one or more of the outer wall surfaces of the plug member; means for supplying tribocharged particles of a dry lubricant to the tubes using a pressurized inert gas; and venting means in the plate; whereby dry lubricant is fed under pressure to the tubes and into the gap when the plug member is within the die cavity so that the lubricant is electrostatically attracted to all wall surfaces of the cavity and excess gas and lubricant is vented from the gap via the venting means.

BRIEF DESCRIPTION OF THE DRAWINGS

FIG. 4 illustrates the sequence of press operations used with the dry lubricant applicator apparatus described in this invention.

FIGS. 5 and 6 illustrate ejection curves for the samples tested in Example 2.

FIGS. 8 and 9 illustrate ejection curves for the samples tested in Example 3.

FIG. 10 illustrates ejection curves for the samples tested in Example 4.

FIGS. 11 and 12 illustrate ejection curves for the samples tested in Example 5.

DETAILED DESCRIPTION OF THE INVENTION

Figure 1:
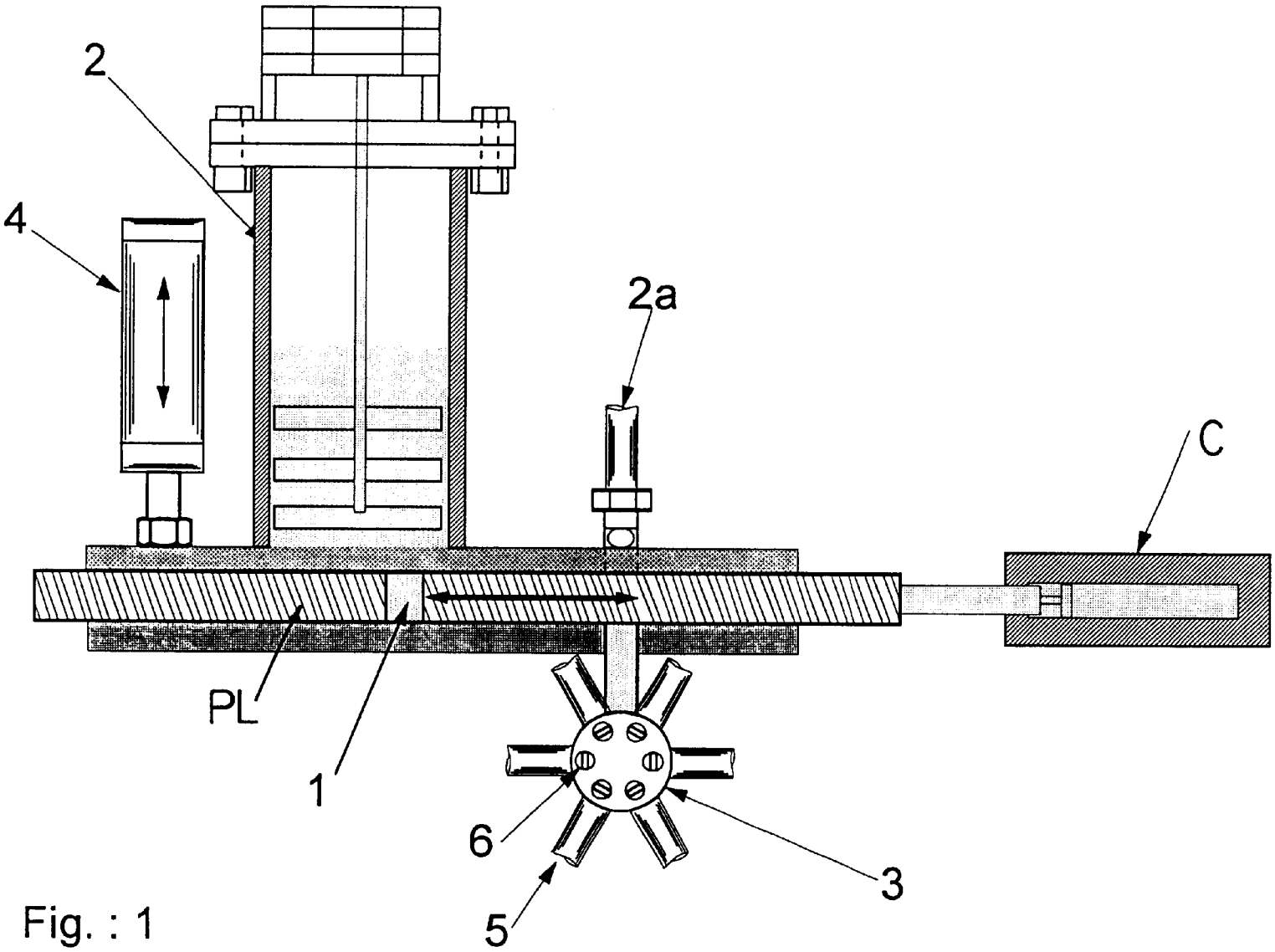
FIG. 1 illustrates a feeding system for the dry lubricant in partial cross-section.
Figure 2A:
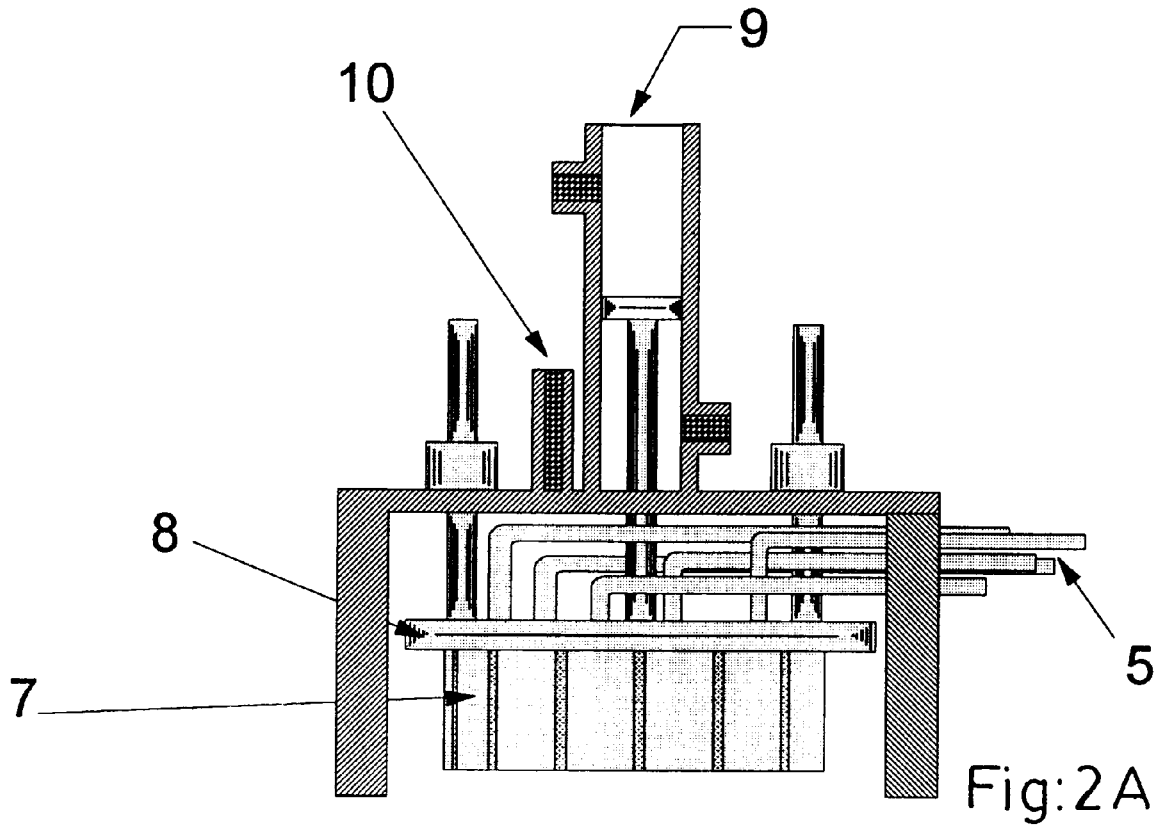
FIG. 2A illustrates a spraying unit including a confining block or plug member in partial cross-section.
Figure 2B:
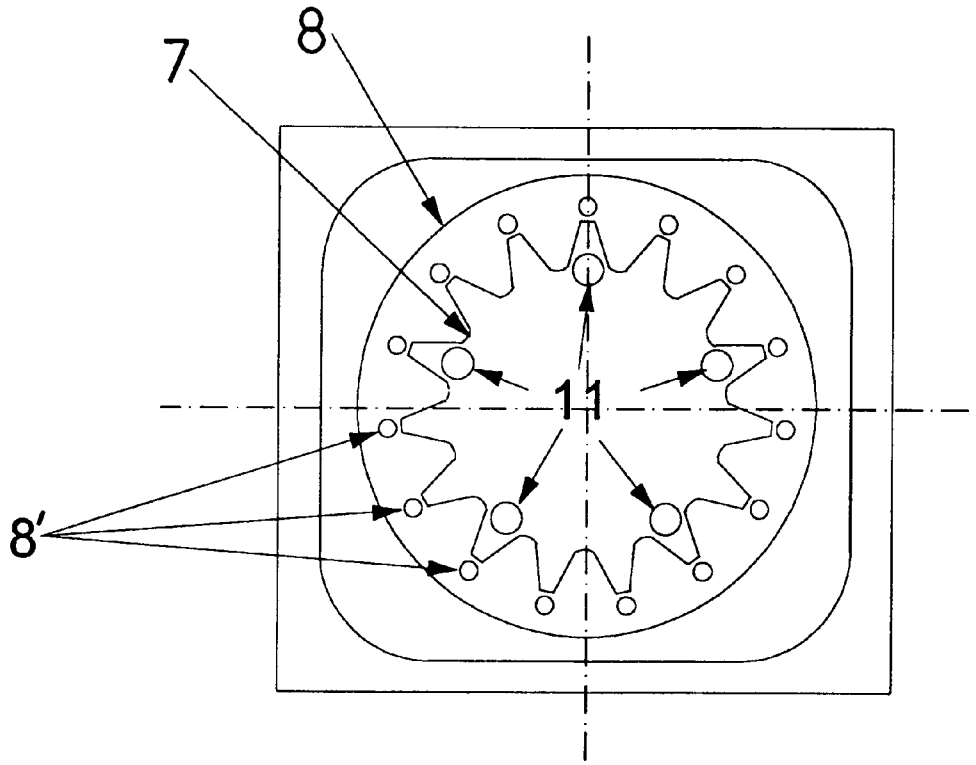
FIG. 2B shows a bottom plan view of the structure of FIG. 2A.

In the present invention, a preferably dry lubricant is tribocharged and electrostatically applied to the die wall surfaces of the die cavity in a solid form. The tribocharged dry lubricant is applied in the form of an aerosol of fine solid particles to the die cavity walls. Preferably, the solid particles have a size of 100 microns or less, more preferably 50 microns or less and most preferably 15 microns or less. More specifically, and with reference to FIG. 1, an accurate volume of dry lubricant is selected by a dosing plate (PL) having a center hole (1) and which can be moved by means of a pneumatic or hydraulic cylinder (C) between a mixing reservoir (2) of lubricant and a pressurized inlet (2A) for dry gas and then flowed by the dry gas to a distributor unit (3). A plurality of tubes (5), preferably formed from polytetrafluoroethylene (Teflon®) connected to the distributor unit (3) transport lubricant away from the distributor unit. The distributor unit is used to control the amount of lubricant fed to each Teflon® tube (5) with the flow rate in each individual tubes being controlled by a set screw (6). A vibratory unit (4) is used to increase the reproducibility of dosing lubricant. During the transport of the lubricant particles, they are tribostatically charged by friction between their external surfaces and the inner wall of the Teflon® tubes (5). This process occurs when the lubricant particles collide with another material such as Teflon®, having a different chemical potential. An independent programmable gas flow unit (not shown) controls the flow of dry gas used to transport the lubricant particles. Dry gas is used because lubricant particles more easily accept static charge in the presence of a clean dry compressed gas such as argon, nitrogen or even air. The exact quantity of tribocharged lubricant used is determined according to the die wall surfaces to be covered and is delivered to a spraying unit shown in FIG. 2.

The spraying unit (FIG. 2A) is composed of a confining block or plug member (7), a dust-proof closing plate (8), a pneumatic actuator (9) and a suction device (10). The tribocharged lubricant particles are transported by the dry gas in Teflon® tubes (5) from the distributor (3) and are fed into holes or tubes (11) machined through the plug member adjacent the outer periphery thereof and then sprayed on the wall surfaces of the die. While the tubes (11) are illustrated (FIG. 2B) as exiting at the bottom wall or surface of the plug member they could easily exit at any other outer wall surface or at any combination of outer wall surfaces of the plug member. The plug member and the dust-proof closing plate are reciprocated by the pneumatic actuator (9). The plug member is introduced into the die cavity while the dust-proof closing plate closes the cavity prior to spraying of the die cavity walls. More precisely, the plug member has a three-dimensional shape conforming generally to the three-dimensional shape of the article or part to be pressed in the die and is designed to occupy a little bit less than the volume of the die cavity. The size and position of the plug member creates a small gap (G) (FIG. 3B) between the outer surface of the plug member and the die cavity walls. When the tribocharged lubricant particles are sprayed from the tubes (11), the particle flow is restricted to the gap (G) created between the plug member and the die walls. A thin lubricating coating is held on the wall surfaces by electrostatic forces that are induced by the approaching charged particles. The same forces, combined with the cloud of tribocharged particles, effect the deposition of a uniform coating in deep corners, recesses, and complex configurations, as well as on all die wall surfaces. The solid lubricant particles are applied quickly and uniformly on the die wall surfaces. The coating is uniform because the charge retained on the lubricant particles tends to deflect incoming particles to uncovered sites. In addition, the dust-proof closing plate has vent orifices or holes (8') which create a preferential and oriented path for the lubricant, control the pressure in the cavity and allow the evacuation of excess lubricant after the spraying step, thereby avoiding lubricant residue, gas turbulence, and dust problems in the die cavity before and during the compaction process. These orifices are located in the closing plate at the top of the die cavity wall. The suction device (10) collects the lubricant particles that pass through the orifices.

Figure 3A:
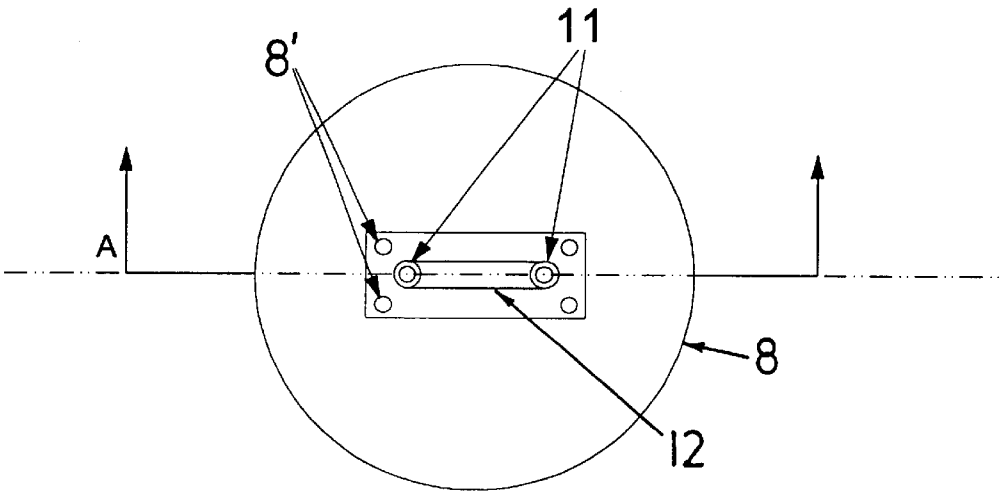
FIGS. 3A to 3D illustrate two different designs of plug member used to apply dry lubricant to die cavity walls: (a) a rectangular plug member (FIGS. 3A and 3B); and (b) a two stage plug member (FIGS. 3C and 3D).
Figure 3B:
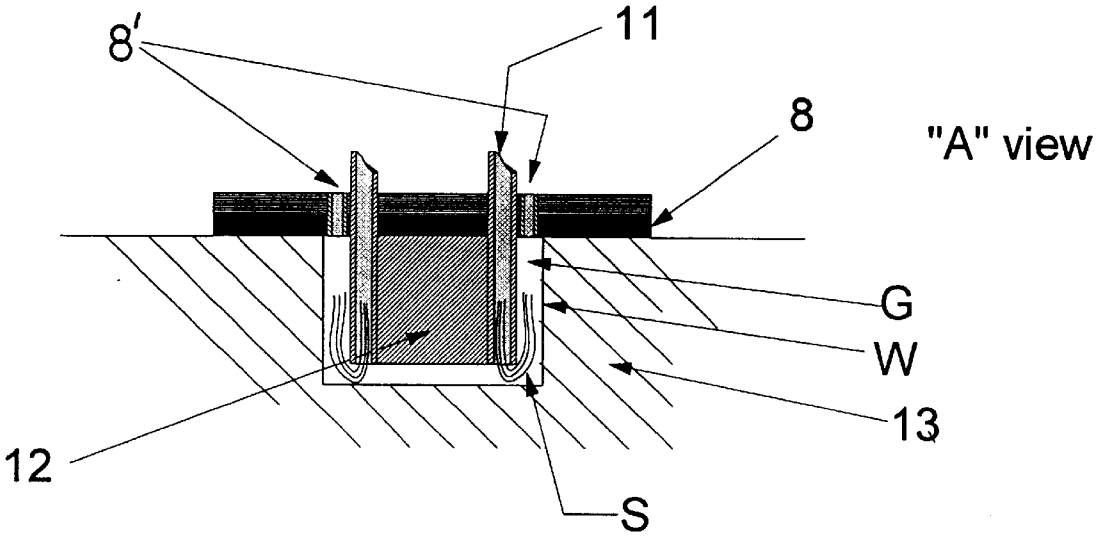
Figure 3C:
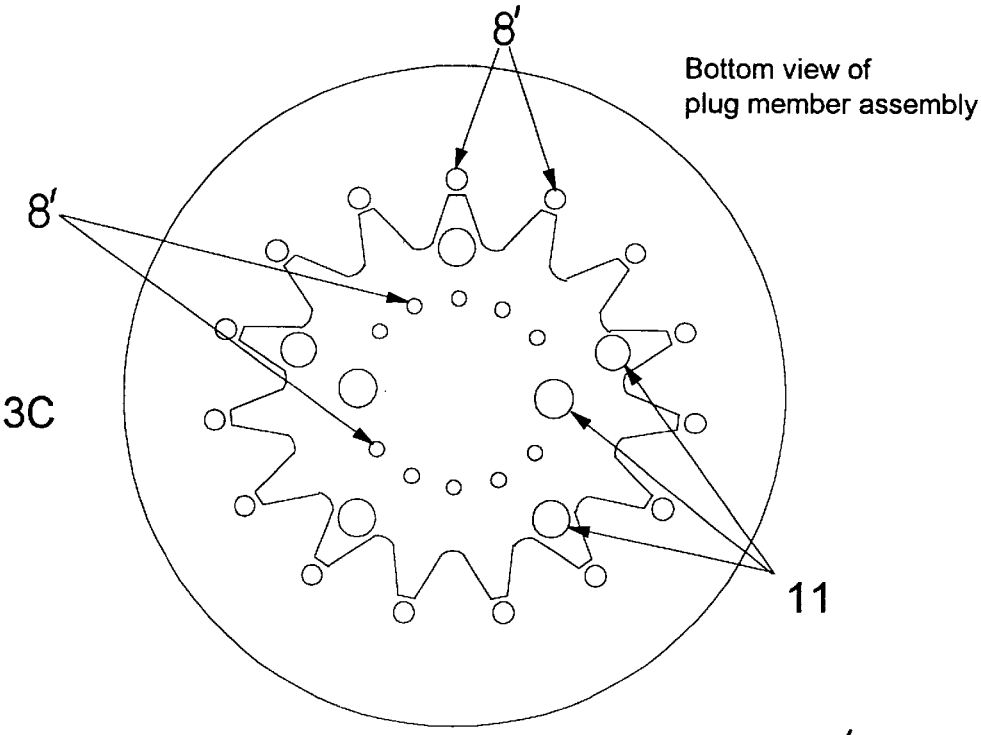
Figure 3D:
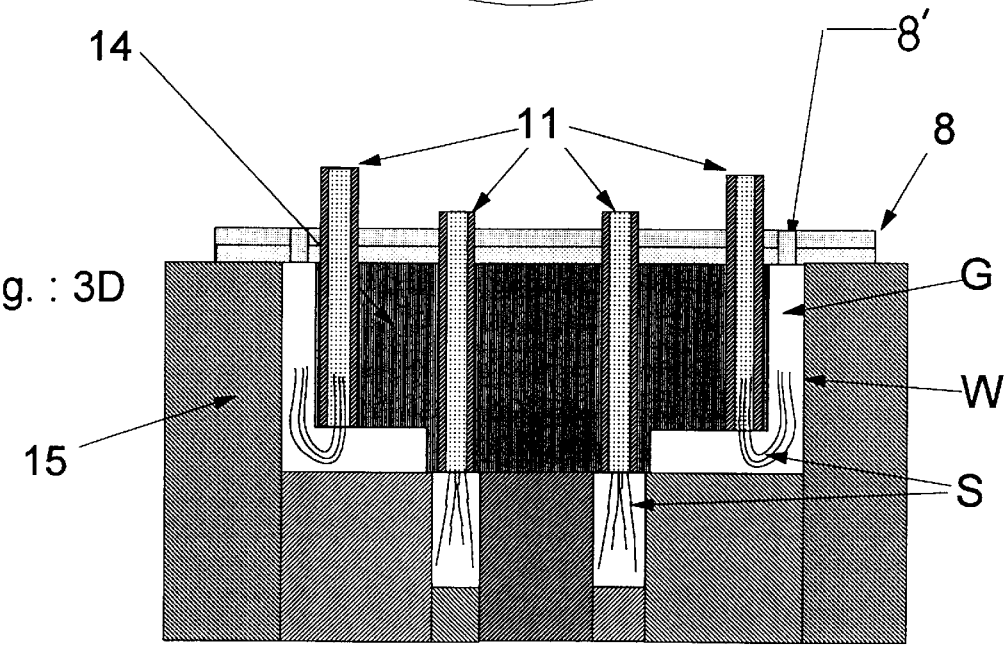
Figure 3E:
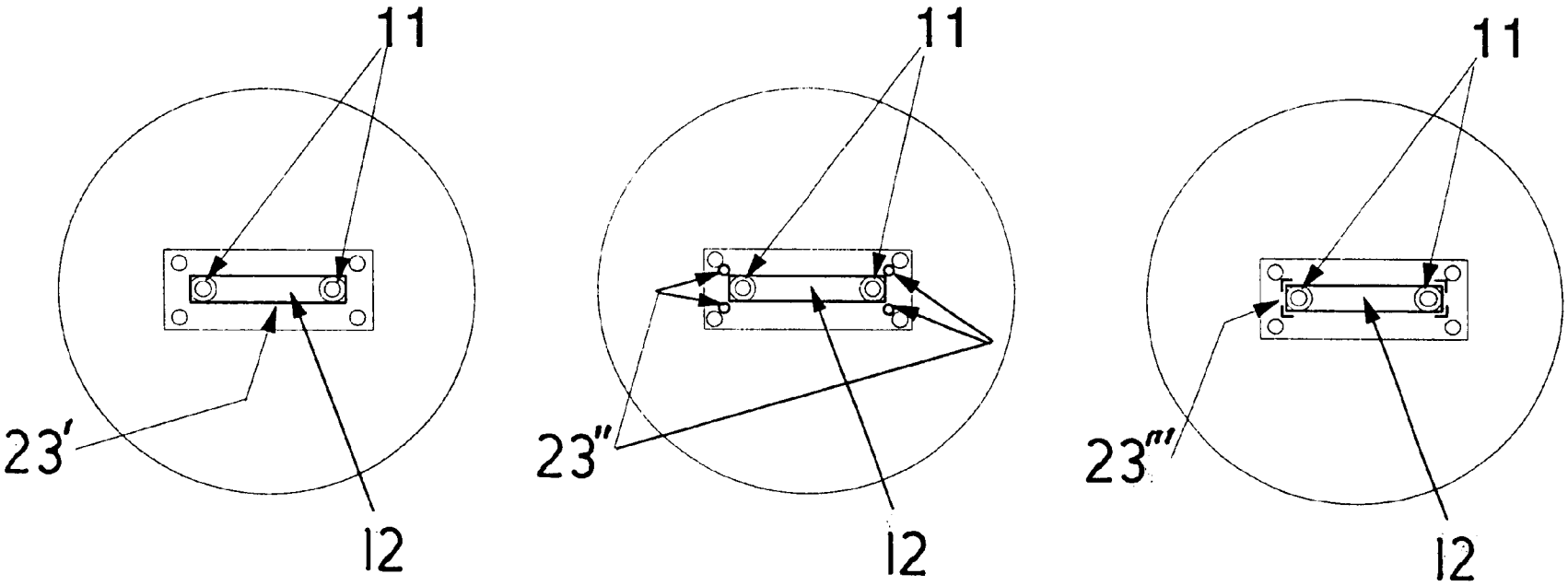
FIG. 3E illustrates three different configurations and shapes of electrodes used to repel the lubricant to the wall cavity if necessary.

Different plug members are designed for different shapes of articles to be made as shown by the two examples presented in FIGS. 3A, 3B, 3C and 3D. In FIGS. 3A and 3B the plug member (12) has a narrow generally parallepiped shape with the tubes (11) being positioned at the ends thereof The plug member (12) fits closely within the die cavity (13) as shown. In the embodiment of FIGS. 3C and 3D the plug member (14) has the shape of a sprocket with the tubes (11) arranged adjacent the outer periphery thereof and the vent orifices (8') also arranged in a similar pattern. In the above-described arrangements, the tribostatically charged lubricant is sprayed from the end of the Teflon® tubes (11) strategically located in the plug member adjacent the periphery thereof, which tubes exit at the bottom of the plug member. The lubricant enters the gap (G) and is distributed as a spray (S) through the gap to the die cavity walls (W). Since the die (13, 15) is connected to ground, electrical attraction will act between the lubricating material and the die, and the lubricant reaches the die walls to be deposited thereon. If necessary, a DC voltage can be applied to electrodes strategically located (FIG. 3E) on and/or around and/or in the plug member (12) and which are electrically isolated from the die to enhance the attraction of the unipolarly charged lubricant to the die wall surfaces. These electrodes can take the form of tape (23') or small rods (23") or any other conducting material (23'") fixed to the confining block or plug member.

As seen in FIG. 4 the unit (16) comprising the actuator and an appropriately shaped plug member is installed on the front of the feeding shoe (18) of an industrial press (P) and is controlled by the same programmable servomotor used to move the feed shoe. The unit (16) can be timed to allow the introduction of the plug member (20) into the die cavity (22) and to spray the lubricant in synchronization with the press cycle (rotation of a camshaft, movement of the upper punch, etc.) (not shown) prior to the introduction of the powder (see FIG. 4 which illustrates the sequence of press operations).

The lubricant powders electrostatically sprayed in accordance with the present invention should ideally have sufficient electrical resistivity that the charges can be generated in the particles. To this end, any solid lubricating material susceptible of acquiring electrical charges through friction can be used with the present invention.

As described above, the lubricants are preferably in dry form but they are not limited to this form. Lubricants in liquid form can also be used. Suitable dry lubricants include metal stearates, such as zinc stearate, lithium stearate, and calcium stearate, ethylene bis-stearamide, polyolefin-based fatty acids, polyethylene-based fatty acids, soaps, molybdenum disulfide, graphite, manganese sulfide, calcium oxide, boron nitride, polytetrafluoroethylene and natural and synthetic waxes.

All lubricants may be used as single component lubricants, or may be used in admixtures of two or more lubricants. Additionally, solid lubricants of various types may be used in any combination as may be desired.

In the process of electrostatically spraying tribostatically charged lubricants on the wall surfaces of a die, lubricant in solid particle form can also be sprayed from nozzles which are directly fed by a Tribogun™. The solid lubricant particles may be preferably sprayed in a dry form or, if desired, dispersed in any suitable solvent or solvent system.

The type of metal powder composition used in association with the present invention may be any conventional metal or ceramic powder compositions, including but not limited to aluminum, magnesium, copper, iron, steel, or steel alloyed powders. Typical iron and steel powders are the ATOMET™ powders manufactured by Quebec Metal Powders Limited (QMP) of Tracy, Quebec, Canada. The metal powder generally has a maximum particle size of less than about 300 microns, preferably less than about 250 microns. The metal powders may also be bound with a suitable binder such as those disclosed in U.S. Pat. Nos. 3,846,126; 3,988,524; 4,062,678; 4,834,800; 5,069,714 and 5,432,223.

Preferably, the lubricant should be tribostatically charged, such as by triboelectric charging. The lubricant may be so charged by forcing the particles with a flow of dry gas through a tube of any non-conductive material, preferably Teflon®. The charge-to-mass ratio of the tribostatically charged lubricant should be above 0.2 $\mu$C/g. Of course, the polarity of the charge-to-mass ratio may vary depending upon the materials selected. Compaction can be conducted with any process, including warm pressing and cold pressing in a die of any desired shape.

Generally speaking, warm pressing is conducted at a pressure of about 30 to 100 tsi (tons per square inch) and at a temperature of about 50° to 300° C. and cold pressing is conducted at a pressure of about 15 to 100 tsi and at a temperature of about 15° to 50° C. After compaction, the green compact is ejected from the die cavity and sintered to form the final part. Secondary operations such as coining, heat-treating, etc. can also be done.

The metal composite part made according to the present invention is capable of achieving, if desired, a final density of greater than 7.30 g/cm.$^3$ and/or a sintered strength of greater than 2,000 MPa. Particularly high green densities may be achieved in accordance with the present invention when the pressed compositions contain a small amount of internal lubricant, on the order of 0.1 and more preferably 0.2–0.3 wt % (in contrast to the 0.75 wt % commonly used in the absence of die wall lubrication). It is also possible to use the present invention without admixed lubricant in the powder particles blend.

The apparatus and the method of the present invention now will be illustrated with the following examples.

EXAMPLE 1

In order to verify the stability of the spraying unit, 20 spraying trials were done. The spraying tests were done in a vessel. Each spray lasted 0.3 seconds under a pressure of dry argon fixed at 10 psi. After each test, the vessel was weighed with an accurate balance. The accuracy of the balance was to ±0.0001 g. The results obtained are presented in the following table:

TABLE 1

| Weight of sprayed lubricant (grams) | | | | | | | | | |
|---|---|---|---|---|---|---|---|---|---|
| Trial 1 | Trial 2 | Trial 3 | Trial 4 | Trial 5 | Trial 6 | Trial 7 | Trial 8 | Trial 9 | Trial 10 |
| 0.0548 | 0.0517 | 0.0438 | 0.0497 | 0.0487 | 0.0487 | 0.0515 | 0.0545 | 0.0432 | 0.0494 |
| Trial 11 | Trial 12 | Trial 13 | Trial 14 | Trial 15 | Trial 16 | Trial 17 | Trial 18 | Trial 19 | Trial 20 |
| 0.0501 | 0.0462 | 0.0496 | 0.0543 | 0.0450 | 0.0458 | 0.0477 | 0.0486 | 0.0451 | 0.0485 |

Referring to Table 1, an analysis of these results clearly shows that the quantities of lubricant sprayed are extremely constant. In fact the average weight of sprayed lubricant is equal to 0.0488 g with a standard deviation of 0.0034 g.

EXAMPLE 2

A metal powder composition of iron powder (ATOMET™ 1001 from Quebec Metal Powders Limited), 0.6 wt % graphite (SW-1651 from Lonza, Inc.) and 0.3 wt % of a lubricant (Acrawax™ C from Lonza) was used for die wall lubrication tests. For comparison purposes, another mix containing ATOMET™ 1001, 0.6 wt % of graphite and 0.6 wt % of Acrawax™ C was also used but without die wall lubrication. A die having rectangular cavity walls was electrostatically sprayed using the apparatus described herein with ethylene bis-stearamide (Acrawax™ C of Lonza) lubricant by blowing tribocharged Acrawax™ C particles by means of dry argon onto the die cavity walls. Each spray lasted 0.3 seconds under a pressure of 15 psi. The metal powder composition was introduced into the die cavity and warm pressed at 65° C. with a pressure of 620 MPa (45 tsi). A quantity of approximately 50 rectangular bars (3.175 cm×1.27 cm×1.2 cm) was pressed and the ejection pressure was recorded for each one of these transverse rupture bars.

The resulting ejection curves for the $1^{st}$, $10^{th}$, $20^{th}$, $30^{th}$, $40^{th}$, and $49^{th}$ rectangular bar pressed from the mix used with the die wall lubrication system are illustrated in FIG. 5. For comparison purposes, the ejection curves for the $1^{st}$, $10^{th}$, $20^{th}$, $30^{th}$, $40^{th}$, and $50^{th}$, rectangular bar pressed without die wall lubrication and with the second mix is presented in FIG. 6.

Referring to FIGS. 5 and 6, it is worth mentioning the differences in the maximum ejection pressures. The ejection pressures are clearly lower when compaction is done with die wall lubrication even if the quantity of admixed lubricant in the second mix is twice the amount of the first mix. A mix containing only 0.3 wt % of admixed lubricant would have given maximum ejection forces, after compaction without die wall lubrication, much higher than those obtained with the mix containing 0.6 wt % of admixed lubricant. It might have also been extremely difficult and even impossible to compact and eject such a mix.

EXAMPLE 3

Figure 7A:
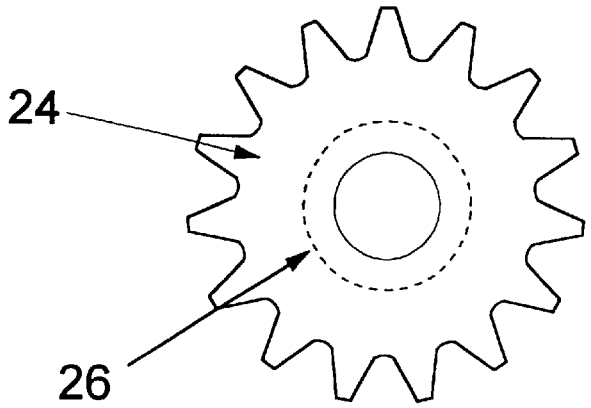
FIGS. 7A and 7B are plan and elevational view of a two-stage part that could be manufactured using this invention.
Figure 7B:
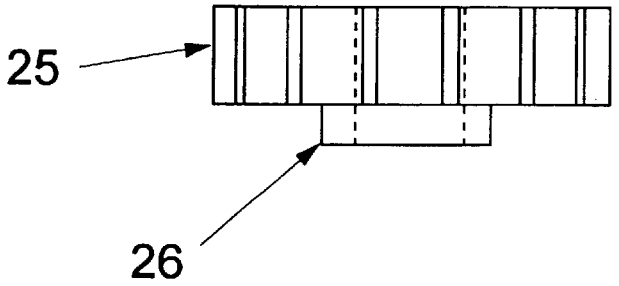

A metal powder composition of iron powder (ATOMET™ 1001 from Quebec Metal Powders Limited), 0.6 wt % graphite (SW-1651 from Lonza, Inc.) and 0.6 wt % of a lubricant (Acrawax™ C from Lonza) was used for this test. A two-stage die having two lower punches and one upper punch was used to compact a two-stage part (24) having sections (25) and (26) of different shapes and sizes. The technical drawing of this part is illustrated in FIGS. 7A and 7B. The die cavity was electrostatically sprayed for the experiment with die wall lubrication, using the apparatus described herein with ethylene bis-stearamide (Acrawax C (of Lonza) lubricant by blowing tribocharged Acrawax™ C particles by means of dry argon into the die cavity. Each spray lasted 0.3 seconds under a pressure of 15 psi. The metal powder composition was introduced into the die cavity and warm pressed at 65° C. with a pressure of 620 MPa (45 tsi). A quantity of 50 parts without die wall lubrication was produced (only with the admixed lubricant) and the green density was measured using the Archimedes method. The ejection force was also measured for each part pressed. The results are presented in the following table:

TABLE 2

Green density of two-stage part compacted at 65° C. and under a pressure of 620 MPa. (0.6 wt % of admixed lubricant)

| | Green Density | | Ejection force |
|---|---|---|---|
| | Average ($g/cm^3$) | Standard Deviation ($g/cm^3$) | Peak (kgf) |
| With Die Wall Lubrication | 7.038 | 0.006 | 4082 |
| Without Die Wall Lubrication | 7.028 | 0.012 | 5443 |

The results presented in Table 2 show that the die wall lubricating system results in slightly higher and more stable green density (0.01 $g/cm^3$) than with only the admixed lubricant. The stability in green density is extremely important for some critical parts. Referring to FIGS. 8 and 9, it is worth mentioning the differences in the maximum ejection pressures. The ejection pressures are clearly lower when the compaction is done with die wall lubrication. There is also an improvement in the surface finish of the parts made with die wall lubrication.

EXAMPLE 4

A metal powder composition of iron powder (ATOMET™ 1001 from Quebec Metal Powders Limited), 0.6 wt % graphite (SW-1651 from Lonza, Inc.) and 0.3 wt % of lubricant (Acrawax C from Lonza) was used for the tests. The same two level die used in Example 3 was used to compact a two-stage part. The die cavity was electrostatically sprayed, for experiments with die wall lubrication, using the apparatus described hereinabove with ethylene bis-stearamide lubricant (Acrawax™ C of Lonza) by blowing tribocharged Acrawax™ C particles by means of dry argon onto the die cavity walls. Each spray lasted 0.3 seconds under a pressure of 15 psi. The metal powder composition was introduced into the die cavity and warm pressed at 65° C. with a pressure of 620 MPa (45 tsi). A quantity of 50 sprockets was pressed with the die wall lubricating system and another 50 parts were pressed without die wall lubrication (only with the admix lubricant) and the green density was measured using the Archimedes method. The ejection force was also measured for each part pressed. The results are presented in the following table:

TABLE 3

Green density of two-stage sprocket compacted at 65° C. and under a pressure of 620 MPa. (0.3 wt % of admixed lubricant)

| | Green Density | | Ejection force |
|---|---|---|---|
| | Average ($g/cm^3$) | Standard Deviation ($g/cm^3$) | Peak (kgf) |
| With Die Wall Lubrication | 7.039 | 0.005 | 5897 |
| Without Die Wall Lubrication | X | X | X |

X = It was impossible to eject the part from the die.

The results presented in Table 3 show that the die wall lubricating system permits making parts with as low as 0.3 weight percent of lubricant in a mix without any problem and with an average green density and standard deviation of the green density similar to those obtained with a higher content (0.6 wt %) of admixed lubricant (see Example 4). However, the parts compacted with only 0.3 weight percent of admixed lubricant (no die wall lubrication) were impossible to eject from the die cavity without breakage. The friction forces, in this case, were higher than the green strength of the parts. Referring to FIGS. 10 and 8, the ejection pressures are slightly higher when compaction is done with less admixed die wall lubrication but it is still acceptable to make sound parts.

EXAMPLE 5

A metal powder composition of iron powder (ATOMET™ 1001 from Quebec Metal Powders Limited), 0.6 wt % graphite (SW-1651 from Lonza, Inc.) and 0.3 wt % of lubricant (Acrawax C from Lonza) was used for the tests. The same two-stage die used in Example 3 was used to compact two-stage parts. The die cavity was electrostatically sprayed, for the experiments with die wall lubrication, using the apparatus described hereinabove with ethylene bis-stearamide lubricant (Acrawax™ C of Lonza) by blowing tribocharged Acrawax™ C particles by means of dry argon onto the die cavity walls. Each spray lasted 0.3 second under a pressure of 15 psi. The metal powder composition was introduced into the die cavity and warm pressed at 65° C. with a pressure of 483 MNa (35 tsi). A quantity of 50 parts was pressed with the die wall lubricating system and another 50 parts were pressed without die wall lubrication (only with the admixed lubricant) and the green density was measured using the Archimedes method. The ejection force was also measured for each part pressed. The results are presented in the following table:

TABLE 4

Green density of two-stage sprocket compacted at 65° C. and under a pressure of 483 MPa. (0.3 wt % of admixed lubricant)

| | Green Density | | Ejection force |
|---|---|---|---|
| | Average ($g/cm^3$) | Standard Deviation ($g/cm^3$) | Peak (kgf) |
| With Die Wall Lubrication | 6.824 | 0.005 | 4990 |
| Without Die Wall Lubrication | 6.756 | 0.087 | 5897 |

The results presented in Table 4 show that the die wall lubricating system results in parts having higher green density and with better stability in the green density. At a low compaction pressure, it is clear that die wall lubrication enhanced the green density. Referring to FIGS. 11 and 12, it is worth mentioning the differences in the maximum ejection pressures. The ejection pressures are clearly lower when the compaction is done with die wall lubrication. There is also an improvement in the surface finish of the parts made with die wall lubrication. In fact measurements made using roughness measuring device on approximately 15 teeth for one part pressed in each condition showed that there is a significant improvement of the surface finish of the part when die wall lubrication is used in comparison to the surface finish of the part made with admixed lubricant. These results are presented in Table 5.

TABLE 5

Roughness measurements of two levels parts compacted at 65° C. and under a pressure of 483 MPa. (0.3 wt % of admixed lubricant)

| | Roughness $R_a$ ($\mu$m) |
|---|---|
| With die Wall Lubrication | 0.6 |
| Without Die Wall Lubrication | 1.4 |

The foregoing has described a preferred form of the apparatus and method of the present invention. It is understood that a skilled practitioner could vary the construction and operation of the invention without departing from the spirit thereof and accordingly the protection to be afforded the invention is to be determined from the claims appended hereto.

What is claimed is:

1. Apparatus for lubricating a wall surface of a die cavity in which a powder will be compacted to form a three-dimensional article and from which the article will be ejected, the die cavity having walls defining the shape of the article, said apparatus comprising: a plug member having a three-dimensional shape generally conforming to that of said article, said plug member being insertable into said die cavity with a narrow gap between the walls of said cavity and adjacent outer wall surfaces of said plug member; a closing plate to which said plug member is secured; means for moving said plug member into said cavity and outwardly therefrom, said closing plate closing said die cavity when said plug member is within said die cavity; a plurality of tubes spaced apart adjacent the periphery of said plug member, extending therethrough and exiting at one or more of said outer wall surfaces of said plug member; means for supplying tribocharged particles of a lubricant material to said tubes using a pressurized inert gas; and venting means in said plate; whereby lubricant material is fed under pressure to said tubes and into said gap when said plug member is within said die cavity so that the lubricant material is electrostatically attracted to all wall surfaces of said cavity and excess gas and lubricant is vented from said gap via said venting means.

2. The apparatus of claim 1 wherein said supplying means includes a source of said lubricant material, a source of said dry inert gas under pressure, distributor means for delivering a precise quantity of said lubricant material to tribocharging means, and means for delivering the tribocharged lubricant particles in said dry inert gas to said tubes in said plug member.

3. The apparatus of claim 1 wherein said moving means comprises a pneumatic cylinder connected to said closing plate, means for supplying air under pressure to said cylinder and control means for activating said cylinder to move said plug member and said plate into and out of said die cavity.

4. The apparatus of claim 2 wherein said tribocharging means comprises a plurality of lengths of a material suitable for electrostatically charging the particles of lubricating material as they pass therealong from said source to said tubes.

5. The apparatus of claim 4 wherein said lengths of material are formed from polytetrafluoroethylene.

6. The apparatus of claim 1 wherein a DC voltage is applied to said plug member to increase the attraction of said tribocharged lubricant particles to the wall surfaces of said cavity.

7. The apparatus of claim 7 wherein said plug member is provided with metallic electrode means to which said DC voltage is applied.

8. The apparatus of claim 1 wherein said tubes exit said plug member at the bottom surface thereof.

* * * * *